United States Patent [19]

Kelly

[11] 4,078,449

[45] Mar. 14, 1978

[54] ADJUSTABLE DETENT APPARATUS

[75] Inventor: Orson K. Kelly, Aurora, Ill.

[73] Assignee: Caterpillar Tractor Co., Peoria, Ill.

[21] Appl. No.: 780,133

[22] Filed: Mar. 22, 1977

[51] Int. Cl.[2] ..... G05G 5/06; G05G 1/04

[52] U.S. Cl. ..... 74/527; 74/526

[58] Field of Search ..... 74/527, 526, 525, 522, 74/519, 529, 491

[56] References Cited

U.S. PATENT DOCUMENTS

| | | | |
|---|---|---|---|
| 912,717 | 2/1909 | Murphy | 74/526 |
| 3,813,080 | 5/1974 | Rogers | 74/527 |
| 3,871,244 | 3/1975 | Gressard et al. | 74/527 |

*Primary Examiner*—Harrison L. Hinson

*Attorney, Agent, or Firm*—John W. Grant

[57] ABSTRACT

A control lever is pivotally fastened to a support assembly and has an end portion movable along an arcuate pathway between a plurality of operating positions. A roller is rotatably fastened to the end portion of the lever and is movable therewith along the arcuate pathway. A detent member has a first end portion pivotally connected to the support assembly and has a normal position adjacent and lying along the arcuate pathway of the roller. A resilient device is connected to the detent member for resiliently biasing the detent member to the normal position. A device is provided for adjustably fastening a detent cam to the detent member at one of a plurality of positions in the arcuate pathway of the roller.

8 Claims, 2 Drawing Figures

ADJUSTABLE DETENT APPARATUS

BACKGROUND OF THE INVENTION

Many control lever arrangements on earthmoving vehicles, such as loaders, are provided with detents to hold the control lever in an operating position so that the operator can remove his hand from the control lever. Heretofore each size of a family of similar vehicles had its own control lever arrangement which was designed specifically for the amount of movement of a particular size hydraulic valve. Thus, the detents were also designed for a preselected amount of movement of the control lever and were not provided with any type of adjusting means. Recently in an attempt to reduce cost, the trend has been to utilize one control lever arrangement design for several different sizes of vehicles. However, one of the problems encountered has been that the total amount of valve spool movement of the hydraulic valves varies from one size to the next thereby necessitating the need for a detent apparatus which can be adjusted in accordance with the amount of lever movement.

The present invention is directed to overcoming one or more of the problems as set forth above.

According to the present invention, there is provided an adjustable detent apparatus for a control lever pivotally fastened to a support assembly, said lever having an end portion movable along an arcuate pathway between a plurality of operating positions. A roller is rotatably fastened to the end portion of the lever and is movable therewith along the arcuate pathway. A detent member is pivotally connected to the support assembly and has a normal position adjacent and lying along the arcuate pathway of the roller. A resilient means is connected to the detent member for resiliently biasing the detent member to the normal position. A means is provided for adjustably fastening a first detent cam to the detent member at one of a plurality of positions in the arcuate pathway of the roller so that the detent cam can be selectively positioned to retain the lever in a first operating position after the roller has depressed and passed by the cam.

DETAILED DESCRIPTION OF THE INVENTION

Figures 1, 2:
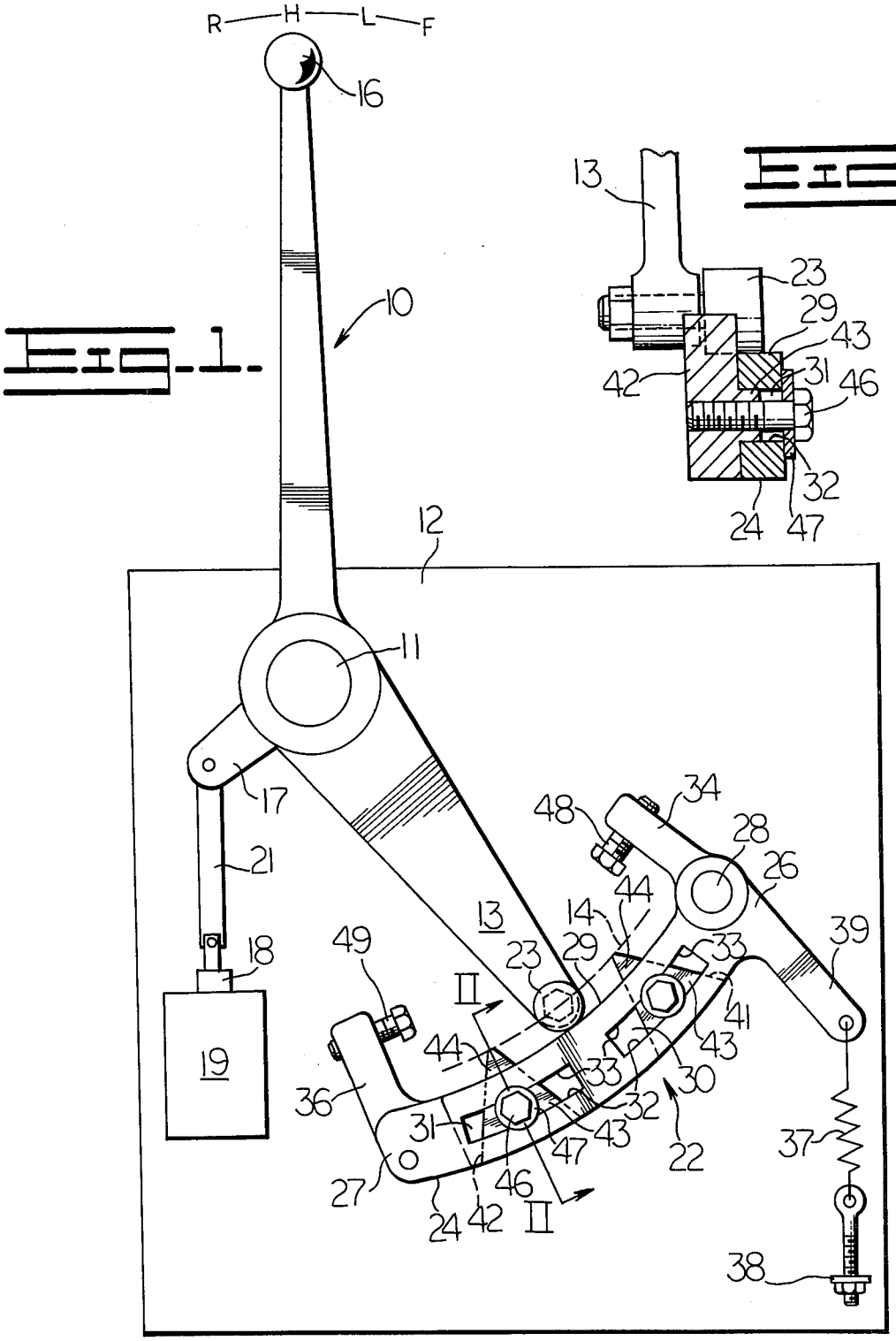
FIG. 1 is a diagrammatic view of an adjustable detent apparatus associated with a control lever.
FIG. 2 is a sectional view taken along line II—II of FIG. 1.

Referring now to FIG. 1, a control lever 10 is pivotally supported on a pivot pin 11 secured to an extending outwardly from a support assembly 12. The lever has an end portion 13 movable along an arcuate pathway generally indicated by the broken line 14 between a plurality of operating positions in response to manual manipulation of a handle portion 16 between the positions indicated by the letters R, H, L and F. An arm 17 of the lever is connected to a valve spool 18 of a self-centering directional control valve 19 through a link 21. The control valve may be of the conventional type employed for example on a loader for selectively moving the lift arms thereof to various positions of operation by suitably arranged lift arms, not shown. Thus, the letter R, H, L and F indicates raise, hold, lower and float positions, respectively, of the control valve. The self-centering mechanism of the control valve is sufficient for normally returning the control lever to the hold position when the operator releases the handle portion.

An adjustable detent apparatus 22 is associated with the control lever 10 for holding it in either the float or raise positions. A roller 23 is rotatably fastened to the end portion 13 of the control lever and is movable therewith generally along the arcuate pathway 14 when the lever is pivoted between the various positions.

A detent member 24 has first and second end portions 26, 27, the first end portion being pivotally connected to the support assembly 12 by a pivot pin 28 extending outwardly from the support assembly. The detent member has a first arcuate surface 29 formed thereon substantially concentric with and adjacent the arcuate pathway when the detent member is in the normal position as shown in FIG. 1. The normal position of the detent member is established by engagement between the first arcuate surface and the roller 23. First and second arcuate slots 30, 31 are formed in the detent member with each cam having opposed arcuate surfaces 32, 33 concentric with the first arcuate surface. First and second arms 34, 36 extend from the first and second ends, respectively, of the detent member in the general direction of the pivot pin 11.

A resilient means such as a spring 37, has one end anchored to a lug 38 of the support assembly 12 and its other end attached to a third arm 39 extending from the first end portion of the detent member. The spring resiliently biases the detent member in a clockwise direction around the pivot pin 28 so that the first arcuate surface 29 is resiliently urged against the roller 23.

First and second detent cams 41, 42 each having a tongue 43 positioned within the respective slots 30, 31 at the first and second end portions 26, 27, respectively of the detent member 24. The tongues have an arcuate shape concentric with the slots. Each of the cams has a triangular-shaped portion 44 which projects above the first arcuate surface 29 and is positioned in the arcuate pathway of the roller 23. Each of the detent cams 41, 42 is fastened to the detent member in the respective position by a threaded fastener or bolt 46 and a washer 47. A first adjustable stop means such as a bolt 48 is threaded into the first arm 34 of the detent member and is positioned in the pathway of the end portion 13 of the control lever 10 for abutment therewith to stop the movement of the lever at a preselected location relative to the detent cam 41 to establish the raise position of the control lever. Similarly, a second adjustable stop means such as a bolt 49 threaded into the second arm 36 is positioned in the pathway of the end portion of the lever for abutment therewith to establish the float position of the control lever.

In the operation of the control valve 19, the operator manually manipulates the handle portion 16 of the control lever 10 from the hold position to one of the operating positions. This, in turn, causes the valve spool 18 to be moved in a rectilinear direction for establishing the various modes of operation. When the contorl lever 10 is pivoted to the raise position, the roller 23 rolls along the first arcuate surface 29 of the detent member 24 and engages and depresses the portion 44 of the first detent cam 41 out of the arcuate pathway of the roller. This pivots the detent member 24 counterclockwise about the pivot pin 28 against the resiliency of the spring 37. After the roller passes the portion 44 of the first detent cam, the spring returns the detent member to the normal position at which portion 44 of the first detent cam is repositioned in the pathway of the roller. The resiliency of the spring 37 is sufficient to hold the control lever in the raise position should the operator remove his hand from the handle portion. The operator may manually return the handle portion back to the hold position by exerting sufficient force thereto for the roller to again depress the first detent cam out of the pathway. Alternately, a solenoid may be suitably attached to the second end portion 27 of the detent member to pivot it in a counterclockwise direction in response to the lift arms reaching a predetermined height thereby automatically allowing the control lever to return to the hold position.

The detent cams 41, 42 may be repositioned and the bolts 48, 49 readjusted to accommodate control valves having different lengths of valve spool movement. For example, should the control valve 19 shown be replaced with one having greater valve spool movement, either one or both of the bolts 48, 49 will be readjusted to a new position to permit the end portion 13 and hence the roller 23 to travel a greater distance along the arcuate pathway 14. The new position of the bolts 48, 49 would be commensurate with the total length of movement of the valve spool and prevent overtravel thereof. Likewise either one or both of the detent cams 41, 42 will be moved to a new position by loosing the respective bolt 46, sliding the cam along the respective arcuate slot 30, 31, and retightening the bolt 46. The slots 30, 31 provides infinitely variable adjustment of the cams.

The embodiments of the invention in which an exclusive property or privilege is claimed are defined as follows:

1. An adjustable detent apparatus for a control lever pivotally fastened to a support assembly, said lever having an end portion movable along an arcuate pathway between a plurality of operating positions, comprising:

a roller rotatably fastened to the end portion of the lever and being movable therewith along the arcuate pathway;

a detent member having a first end portion pivotally connected to the support assembly, said detent member having a normal position adjacent and lying along the arcuate pathway of the roller;

resilient means connected to the detent member for resiliently biasing the detent member to the normal position;

a first detent cam; and first means for adjustably fastening the detent cam to the detent member at one of a plurality of positions in the arcuate pathway of the roller.

2. The adjustable detent apparatus of claim 1 including a first adjustable stop means fastened to the support member and positioned in the pathway of the end portion of the lever for stopping the lever at a preselected location relative to the detent cam.

3. The adjustable detent apparatus of claim 2 including a second detent cam and second means for adjustably fastening the second detent cam to the detent member at a second position in the arcuate pathway of the roller.

4. The detent apparatus of claim 3 wherein said first means includes at least one opening extending through the detent member and a threaded fastener extending through said opening and being of a construction sufficient for securing the first detent cam to the detent member at preselected positions.

5. The adjustable detent apparatus of claim 4 wherein said detent member has a first arcuate surface formed thereon, said first arcuate surface being substantially concentric with the arcuate pathway of the roller at the normal position of the support member.

6. The adjustable detent apparatus of claim 5 including a plurality of separate openings spaced along an arcuate pathway substantially concentric with the arcuate pathway of the roller.

7. The adjustable detent apparatus of claim 6 wherein each opening is an arcuate slot having a second arcuate surface disposed substantially concentric with the first arcuate surface, said first and second detent cams each having a tongue projecting into one of said arcuate slots.

8. The adjustable detent apparatus of claim 7 including a control valve, and means for connecting the control lever to the control valve.

* * * * *